United States Patent [19]

John

[11] 4,150,710

[45] Apr. 24, 1979

[54] DUMMY BAR HANDLING APPARATUS AND METHOD

[75] Inventor: Wolfgang W. John, New York, N.Y.

[73] Assignee: Concast Incorporated, Montvale, N.J.

[21] Appl. No.: 847,903

[22] Filed: Nov. 2, 1977

[51] Int. Cl.[2] ..... B22D 11/08

[52] U.S. Cl. ..... 164/82; 164/426

[58] Field of Search ..... 164/425, 426, 445, 446, 164/82

[56] References Cited

U.S. PATENT DOCUMENTS 3,817,316 6/1974 Koch et al. ..... 164/426

FOREIGN PATENT DOCUMENTS 37816 9/1972 Japan ..... 164/445

17942 6/1976 Japan ..... 164/426

*Primary Examiner*—Richard B. Lazarus

*Assistant Examiner*—John S. Brown

*Attorney, Agent, or Firm*—Tobias Lewenstein

[57] ABSTRACT

A continuous casting installation has a generally vertical open-ended mold supported on a casting platform, a flexible dummy bar for sealing the lower end of the mold prior to the start of a cast, a curved guide below the casting platform for the strand formed in the mold and a mechanism for handling the dummy bar. This mechanism includes a carriage which is provided with a semi-circular, downwardly concave roller bed having a length at least equal to that of the dummy bar. The carriage is located on the casting platform and is movable between the mold and a location above that at which the dummy bar emerges from the strand guide. A rotatably driven, telescopic arm on the carriage pivots on the axis of the semi-circular roller bed. The arm is capable of engaging the dummy bar. In operation, the carriage is positioned above the location at which the dummy bar emerges from the strand guide. The leading end of the dummy bar is engaged by a hoist as it emerges from the strand guide and is lifted to the level of the casting platform. The arm on the carriage is extended and engages the leading end of the dummy bar. Thereafter, the arm is rotated thereby pulling the entire dummy bar onto the semi-circular roller fed. The dummy bar is then clamped on the roller bed and the arm is disconnected from the leading end of the dummy bar and rotated back to engage the trailing end of the dummy bar. The carriage is moved to a position adjacent the mold. Subsequently, the clamping force on the dummy bar is released and the arm is rotated towards the mold thereby lowering the dummy bar into the strand guide via the top of the mold and positioning the dummy bar to seal the lower end of the mold in readiness for another cast.

9 Claims, 3 Drawing Figures

DUMMY BAR HANDLING APPARATUS AND METHOD

FIELD OF THE INVENTION

The invention relates generally to continuous casting, and especially the continuous casting of metals, e.g. steel.

More particularly, the invention relates to the handling of the dummy bar which is used in continuous casting installations to seal one end of an open-ended mold prior to the start of a cast and to initiate withdrawal of the continuously cast strand from the mold.

BACKGROUND OF THE INVENTION

Most continuous casting installations for steel in operation today have a generally vertical mold followed by a guide for the strand or ingot continuously formed in the mold. At least a portion of the guide is curved in such a manner that the strand is deflected from a generally vertical orientation to a generally horizontal orientation. A straightener is arranged at the end of the curved portion of the guide for the purpose of straightening the strand.

In the continuous casting of steel with a generally vertical open-ended mold, the lower or outlet end of the mold is sealed before the start of the cast so that the strand may have a chance to form. The sealing is accomplished by means of a dummy bar having a head which fits in the outlet end of the mold with little clearance. The dummy bar is flexible, e.g. composed of pivotally connected links, so that it may conform to the curvature of the strand guide. The dummy bar head is provided with means which enable the strand to become coupled with the dummy bar head so that, when the dummy bar is moved downwardly along the strand guide to unblock the outlet end of the mold, the strand is pulled along; In this manner, withdrawal of the continuously cast strand from the mold is initiated. Once withdrawal of the strand has been properly initiated, the dummy bar may be disconnected from the strand.

When the dummy bar head is in its sealing position, it is situated at the top of the dummy bar which, in turn, extends along the strand guide located below the mold. Normally, the dummy bar is positioned in this manner in one of two ways. Thus, it may be fed through the straightener and passed upwardly through the strand guide. On the other hand, it may be lowered through the mold. The latter procedure has the advantage that shorter preparation periods between two casts may be achieved.

A known arrangement for introducing a flexible dummy bar into the strand guide via the mold includes a transfer device which is movably mounted on the casting platform supporting the mold. The dummy bar is lifted from the strand guide to the casting platform when withdrawal of a strand has been initiated by the dummy bar. The latter is loaded onto the transfer device at a location spaced from the mold. Once casting of the strand has been completed, the transfer device lowers the dummy bar through the inlet end of the mold so that the dummy bar may be readied for the start of another cast.

The transfer device is provided with a horizontal roller table which is bounded on either side by a roller track in the form of a quarter of a circle. The dummy bar is loaded onto the horizontal roller table via one of the curved tracks by a cable winch. This cable winch is uncoupled from the dummy bar before introducing the latter into the mold and the dummy bar is then held by a pair of driven rollers. The rollers cause a frictional clamping force to exist between the dummy bar and the transfer device.

The clamping force has the disadvantage that the errors in positioning the dummy bar on the horizontal roller table and the errors in positioning the transfer device may be cumulative and consequently lead to difficulties during the introduction of the dummy bar into the mold. Thus, in spite of the fact that the dummy bar and its head are designed to fit in the mold cavity with a certain amount of play, it is not possible to avoid scratching the inner walls of the mold. In addition to this disadvantage of the transfer device, a difficulty arises from the relatively small, curved roller tracks connected with either end of the horizontal roller table and, in particular, from the curved roller track connected with that end of the horizontal roller table via which the dummy bar is introduced into the mold. This difficulty, which exists for flexible dummy bars composed of pivotally connected links, stems from the fact that the individual links tilt upon being displaced from the horizontal roller table onto the curved roller track. The tilting movements of the links cause the dummy bar to be fed into the mold in a jerky fashion and it is not possible to eliminate the possibility of damage to the inner walls of the mold. A further disadvantage of the transfer device resides in that the horizontal roller table has a length approximating that of the dummy bar and accordingly takes up a large amount of space on the casting platform.

Another known arrangement for introducing a flexible dummy bar into the strand guide via the mold also includes a transfer device having a roller table for the dummy bar. Here, the roller table is pivotable from a horizontal to a vertical orientation and is swung to its vertical orientation during loading of the dummy bar. A lifting mechanism which is independent of the roller table lifts the dummy bar from the strand guide to the level of the casting platform in such a manner that the dummy bar also has a vertical orientation. The dummy bar is then transferred to the vertically oriented roller table by hanging it on a hook which is provided on the roller table for this purpose. Subsequently, the roller table is rotated back to its horizontal orientation. The dummy bar is now moved over the roller table towards the mold via a finger which is driven by a chain drive and travels along the roller table. The finger is able to control the speed of the dummy bar during the introduction thereof into the mold.

The latter arrangement also has certain disadvantages. Thus, it is expensive, particularly because of the mechanisms which must be provided for rotating the roller table. Furthermore, the errors in positioning the roller table for the introduction of the dummy bar into the mold are relatively large due to the pivotal mounting of the roller table. Moreover, the roller table has a length approximating that of the dummy bar. As a result, the roller table again takes up a large amount of space on the casting platform.

OBJECTS OF THE INVENTION

It is an object of the invention to provide an arrangement and a method which make it possible to introduce a flexible dummy bar into the strand guide of a continuous casting installation via the mold in such a manner that the dummy bar is accurately centered with respect to the mold.

Another object of the invention is to provide an arrangement and a method which make it possible to introduce a flexible dummy bar into the strand guide of a continuous casting installation via the mold with a high degree of uniformity.

An additional object of the invention is to provide an arrangement and a method which make it possible to use a simple drive mechanism for properly positioning a flexible dummy bar and then introducing the dummy bar into the strand guide of a continuous casting installation via the mold.

A concomitant object of the invention is to provide an arrangement and a method which make it possible to introduce a flexible dummy bar into the strand guide of a continuous casting installation via the mold using less space on the casting platform than heretofore.

SUMMARY OF THE INVENTION

The foregoing objects, as well as others which will become apparant as the description proceeds, are achieved in accordance with the invention.

One aspect of the invention relates to a continuous casting installation, e.g. for the casting of metals, which includes a casting floor or platform and an open-ended mold supported by the casting platform. The installation further includes a flexible dummy bar, e.g. a dummy bar composed of pivotally connected links, for sealing the outlet end of the mold prior to the start of a cast and for initiating withdrawal of a continuously cast strand from the mold. A guide is arranged below the casting platform to guide the strand along a predetermined path. Furthermore, means is provided for lifting the dummy bar from the guide to a predetermined location of the casting platform spaced from the mold, transferring the dummy bar from this predetermined location to the mold and inserting the dummy bar into the guide via the inlet end of the mold. This lifting, transferring and inserting means comprises a carriage on the casting platform which is movable between a location adjacent the mold and the predetermined location of the casting platform to which the dummy bar is delivered from the strand guide. The carriage is provided with a part-circular, downwardly concave support for the dummy bar and an arm for engaging the dummy bar. This arm is pivotally mounted on the axis of the support so that rotation of the arm in a predetermined sense when it engages the dummy bar causes the latter to be drawn onto the support.

Another aspect of the invention relates to a continuous casting method which involves sealing the outlet end of an open-ended mold with the trailing end of a flexible dummy bar. The mold is supported on a casting platform and molten material, e.g. steel, is teemed into the inlet end of the mold to begin formation of a continuously cast strand. The dummy bar is moved downwardly from the mold along a predetermined path to initiate withdrawal of the strand from the mold and, after the withdrawal of the strand has been initiated, the dummy bar is removed from the path of the strand. The removal of the dummy bar is performed by lifting the dummy bar so that the leading end thereof is raised to the region of a predetermined location of the casting platform which is spaced from the mold. A carriage according to the invention as outlined above is positioned adjacent this predetermined location of the casting platform and the dummy bar is drawn onto the part-circular, downwardly concave support of the carriage by engaging the leading end of the dummy bar with the arm on the carriage and rotating the arm in a sense causing the dummy bar to come to rest on the support. The arm is disengaged from the leading end of the dummy bar and rotated back towards the position it had upon engaging the leading end of the dummy bar. The trailing end of the dummy bar is now engaged by the arm. The carriage is moved to a position adjacent the mold and the arm is rotated in the same sense as when it was in engagement with the leading end of the dummy bar. In this manner, the dummy bar is lowered through the inlet end of the mold to a position in which the trailing end of the dummy bar seals the outlet end of the mold preparatory to the start of another cast.

It may be desirable to arrest the dummy bar on the part-circular support before the arm is disengaged from the leading end of the dummy bar in order to prevent the dummy bar from sliding. The dummy bar may be released after the arm has engaged the trailing end thereof.

The support provided for the dummy bar is advantageously semi-circular or approximately so. It is further favorable for the length of the support to be at least equal to the length of the dummy bar.

The combination of a rotatable arm and a semi-circular support having a length at least equal to the length of the dummy bar enables advantages to be realized in the loading of the dummy bar onto the support and in the feeding of the dummy bar into the mold. The relatively large diameter of the semi-circular support, which results from the fact that the length of the latter at least equals the length of the dummy bar, is able to provide improved uniformity of movement of the dummy bar into the mold for a dummy bar composed of links of conventional length. Abrupt tilting of the individual links may be virtually eliminated. Furthermore, the rotatable arm which cooperates with the semi-circular support represents a simple concept for the loading of the dummy bar onto the support and the introduction of the dummy bar into the mold. The arm accomplishes both the loading of the dummy bar and the feeding thereof into the mold. Moreover, the coupling of the arm to the leading end of the dummy bar as contemplated by the invention for the purpose of loading the dummy bar enables an accurate positioning of the dummy bar on the semi-circular support to be achieved. The subsequent coupling of the arm to the trailing end of the dummy bar, contributes to accurate positioning of the dummy bar as regards lateral displacements of the latter before and during the introduction thereof into the mold. Accordingly, the dummy bar, which normally has little play in the mold cavity, may be accurately fed into the mold. The invention provides the further advantage that the semi-circular support, which is firmly secured to the chassis of the carriage, may be lightweight and yet be of rigid construction. The rigid construction insures that close tolerances may be maintained during the introduction of the dummy bar into the mold. In addition to the advantages already listed, the semi-circular support enables a favorable height-to-length ratio to be obtained. This, in turn, leads to a reduction in the space required for the arrangement of the invention on the casting platform.

During the period that the dummy bar is resting on the support and the arm is being rotated from the leading end of the dummy bar towards the trailing end thereof, the dummy bar may be prevented from sliding by frictional forces. However, according to a favorable embodiment of the invention, the support is provided with rollers on which the dummy bar rests. In such an event, an arresting device for the dummy bar is advantageously provided on the support or the carriage. A preferred construction for the arresting device resides in a piston-and-cylinder unit which is activated by a pressure medium and includes a fork-like portion for engaging the dummy bar.

The precision with which the dummy bar may be introduced into the mold depends upon the tolerances which can be maintained for the positioning of the dummy bar on the carriage and for the positioning of the carriage itself upon the casting platform. Under the rough conditions which are known to exist during casting operations, it is difficult to maintain close tolerances for the positioning of the carriage on the casting platform even when considerable expense is incurred towards this end. Therefore, a particularly advantageous embodiment of the invention incorporates a centering device for the dummy bar at the exit end of the support, that is, at that end of the support via which the dummy bar leaves the support to enter the mold. It is possible for the centering device to be adjustable. The dummy bar, which has its trailing end coupled with the rotatable arm during the introduction into the mold, may be precisely centered by the centering device at a location immediately above the mold.

A favorable embodiment of the invention contemplates for the rotatable arm to be telescopic. Here, it is of further advantage when the arm has an axially movable portion of fork-like shape which is arranged to engage the dummy bar.

Another embodiment of the invention provides for the arm to be rotatably driven by a chain which is arranged in such a manner that at least a portion thereof is concentric with the arcuate dummy bar support.

The arm may be mounted so as to rotate close to the dummy bar support. This enables accurate positioning of the dummy bar on the support to be achieved.

BRIEF DESCRIPTION OF THE DRAWINGS

Other features and advantages of the invention will become apparent from the drawings wherein.

DESCRIPTION OF THE PREFERRED EMBODIMENTS

Figure 1:
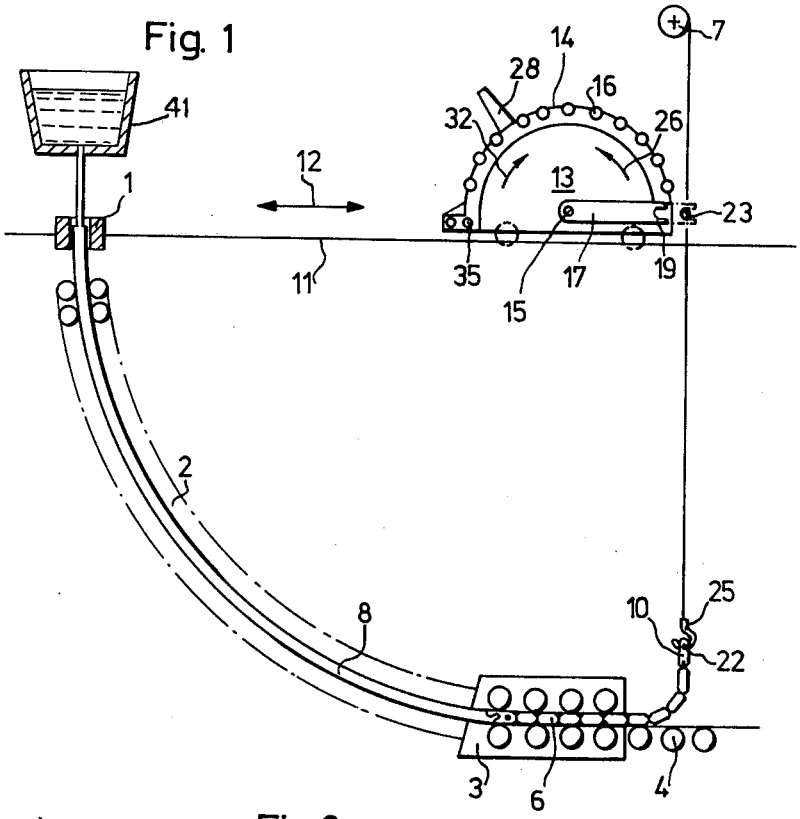
FIG. 1 is a schematic partially sectional side view of a continuous casting installation having an arrangement in accordance with the invention.

FIG. 1 schematically illustrates a portion of a continuous casting installation. Details of continuous casting installations are well-known and will not be discussed here except as is necessary for an understanding of the invention. Although the installation shown is intended for the casting of steel, the invention is not to be construed as limited to the casting of steel only.

The installation includes a mold 1 having a generally vertical orientation. The mold 1 is open-ended, that is, has a generally vertical casting passage which is open at the upper or inlet end of the mold 1 and the lower or outlet end of the latter. The mold 1 is supported on a casting platform 11 and molten steel is admitted into the inlet end of the mold 1 from a vessel 41, such as a tundish, positioned above the mold 1.

A guide 2 is arranged below the casting platform 11 and guides a continuously cast strand 8 formed in the mold 1. The guide 2 may, for example, include a series of roller pairs arranged adjacent to one another to define a path for the strand 8. The guide 2 is curved so that the strand 8 is gradually turned from a generally vertical orientation to a generally horizontal orientation. Although the guide 2 is here illustrated as being curved in its entirety, it is possible for only a portion of the guide 2 to be curved. The configuration of the guide 2 will depend upon the type of continuous casting installation being used.

A withdrawal and straightening unit 3 follows the guide 2 in the casting direction, that is, the direction of movement of the strand 8. The unit 3 serves to straighten the strand 8 and also helps to continuously withdraw the latter from the mold 1 as molten steel continues to be poured into the mold 1 and the strand 8 continues to form. A roller table 4 is situated beyond the unit 3, and the strand 8 travels away from the unit 3 over the roller table 4 for further processing.

A dummy bar 6 is provided and serves to seal the outlet end of the mold 1 prior to the start of a cast so that the strand 8 has a chance to begin forming. The end of the dummy bar 6 which plugs the outlet end of the mold 1, that is, the trailing end of the dummy bar 6, includes a dummy bar head formed in such a manner that it is able to become coupled with the initially formed portion of the strand 8. Thus, when the dummy bar 6 is pulled away from the mold 1 so as to unblock the outlet end thereof, it is able to draw the strand 8 behind it and thereby initiate withdrawal of the strand 8 from the mold 1. The dummy bar 6, which is engaged by driven rollers, may be disconnected from the strand 8 once the strand 8 itself is being suitably driven by rollers or other means. The dummy bar 6 and the strand 8 are conveniently disconnected after the dummy bar 6 has passed through the withdrawal and straightening unit 3.

The dummy bar 6 is flexible so that it may conform to the curvature of the guide 2. As is clear from FIG. 1, the dummy bar 6 is here formed from pivotally connected links.

The installation includes an arrangement for lifting the dummy bar 6 from the roller table 4 to the casting platform 11, transferring the dummy bar 6 to the mold 1 and inserting the dummy bar 6 into the guide 2 via the inlet end of the mold 1 so as to position the dummy bar 6 in readiness for another cast. This arrangement incorporates the concepts of the invention.

Figure 2:
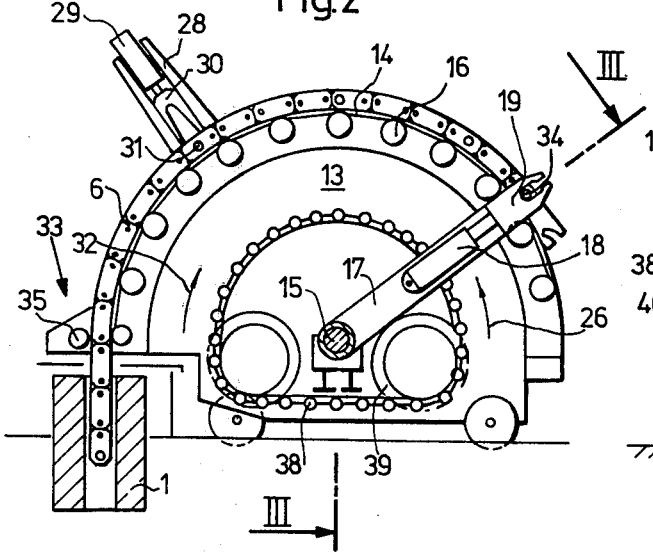
FIG. 2 is a partially sectional side view of the installation of FIG. 1 showing the arrangement of the invention in an enlarged form.

Referring to FIGS. 1 and 2, the arrangement of the invention includes a carriage 13 which is movable along the casting platform 11 from a location adjacent the mold 1 as shown in FIG. 2 to a location which is more or less above the exit end of the withdrawal and straightening unit 3 as shown in FIG. 1. The directions of movement of the carriage 13 are indicated by the arrow 12. The dummy bar 6 is loaded onto the carriage 13 at the location above the exit end of the unit 3 and discharged from the carriage 13 into the mold 1 at the location adjacent the latter.

Figure 3:
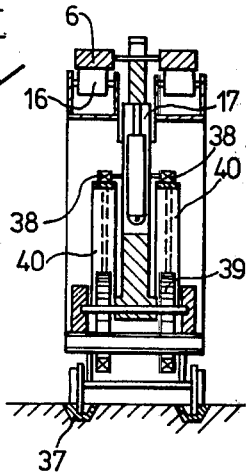
FIG. 3 is a view in the direction of the arrows III—III of FIG. 2.

As illustrated in FIG. 3, the carriage 13 travels on rails 37 which insure that the carriage 13 is accurately positioned for both the loading and discharging of the dummy bar 6.

The carriage 13 is provided with a downwardly concave, semi-circular support 14 for the dummy bar 6. The support 14 includes a series of rollers 16 on which the dummy bar 6 rests upon having been loaded onto the carriage 13. The length of the support 14 is at least equal to the length of the dummy bar 6.

A vertical roller section 35 may be provided at one or both ends of the support 14. In the event that the vertical roller section 35 is provided at that end 33 of the support 14 via which the dummy bar 6 is discharged into the mold 1, it is possible to construct this vertical roller section 35 in the form of a centering device which aids in centering the dummy bar 6 with respect to the mold 1. The device 35 includes rollers which accurately guide the dummy bar 6 immediately before the introduction thereof into the mold 1.

The carriage 13 is further provided with an arm 17 which is rotatably mounted on a pivot 15 extending along the axis of the imaginary cylinder on which the support 14 is situated. The directions of rotation of the arm 17 are indicated by arrows 26 and 32, respectively. The arm 17 is rotatably driven by means of a pair of chains 38 which pass over sprocket wheels 39 connected to a reversible drive mechanism. As best seen in FIG. 3, a chain 38 is arranged on either side of the arm 17 as is a guide 40 for the respective chains 38. The chains 38 are so arranged that at least a portion of each of their paths of travel is concentric with the semi-circular support 14.

The arm 17 is telescopic and includes a portion 19 of fork-like shape which is movable axially of the arm 17 and is adapted to engage the dummy bar 6. The fork-like portion 19, may, for instance, constitute part of a piston-and-cylinder unit 18 which is activable by means of a pressure medium to extend and retract the fork-like portion 19. FIG. 1 shows the retracted position of the fork-like portion 19 in full lines whereas the extended position thereof is indicated by dash-to-dot lines.

An arresting device 28 is mounted on the support 14 to prevent the dummy bar 6 from moving during those periods when the dummy bar 6 is not engaged by the arm 17. The arresting device 28 includes a piston-and-cylinder unit 29 which is activable by means of a pressure medium. The unit 29 has a fork-shaped part 30 which is movable in radial direction of the support 14 and is adapted to hold the dummy bar 6 in position on the support 14.

A lifting device 7 is provided to lift the dummy bar 6 from the generally horizontal roller table 4 to the casting platform 11. The lifting device 7 includes a hook 25 for engaging the dummy bar 6. Although the lifting device 7 is here shown as being independent of the carriage 13, it may be advantageous in certain instances to mount the lifting device 7 on the carriage 13 so that the lifting device 7 travels along with the carriage 13.

In operation, the dummy bar head provided at the trailing end of the dummy bar 6 plugs the outlet end of the mold 1 before the start of a cast. Once the outlet end of the mold 1 has been plugged, molten steel is teemed into the mold 1 in conventional manner. The first quantities of molten steel entering the mold 1, which represent the initial portion of the strand 8, solidify in contact with the dummy bar head and are coupled thereto. Subsequently, the dummy bar 6 is drawn away from the mold 1 via driven rollers at a rate conforming to the rate of introduction of molten steel into the mold 1. The dummy bar 6 draws the strand 8 behind it thereby initiating the withdrawal of the strand 8 from the mold 1.

When the leading end 10 of the dummy bar 6 has exited from the withdrawal and straightening unit 3, it is engaged by the hook 25 of the lifting device 7 as shown in FIG. 1. The hook 25 hooks onto a bolt 22 provided in the leading end 10 of the dummy bar 6. The lifting device 7 raises the dummy bar 6 from the generally horizontal roller table 4 onto which the dummy bar 6 passes from the unit 3. By this action, the lifting device 7 causes the dummy bar 6 to be disconnected from the strand 8 once the initial portion of the latter has exited from the unit 3. The dummy bar 6 is raised until the bolt 22 has reached a location 23 in the region of the casting platform 11.

The carriage 13 is positioned adjacent to the location 23 with the rotatable arm 17 facing the location 23. When the bolt 22 has reached the location 23, the fork-like portion 19 of the arm 17 is brought to the extended position shown in dash-and-dot lines in FIG. 1. This causes the fork-like portion 19 to engage the bolt 22 and, hence, the dummy bar 6. The hook 25 is disengaged from the dummy bar 6.

The arm 17 is now rotated in the direction of the arrow 26. In this manner, the dummy bar 6 is drawn onto the semi-circular support 14 so as to rest on the rollers 16.

Once the dummy bar 6 has been loaded onto the support 14, the arresting device 28 is activated to secure the dummy bar 6 in position. The fork-shaped part 30 of the arresting device 28 cooperates with a bolt 31 provided on the dummy bar 6 to hold the latter and thereby prevent it from sliding off the support 14.

When the dummy bar 6 has been secured by the arresting device 28, the fork-like portion 19 of the arm 17 is retracted thus disengaging the dummy bar 6 from the arm 17. The arm 17 is now rotated in the direction of the arrow 32 from the leading end 10 of the dummy bar 6 to the trailing end thereof. Subsequent to rotation of the arm 17, the fork-like portion 19 is extended to engage a bolt 34 provided at the trailing end of the dummy bar 6. In this manner, the arm 17 is again coupled with the dummy bar 6.

After the cast in progress has been completed, the carriage 13 is moved to a location adjacent to the mold 1 as illustrated in FIG. 2. The arresting device 28 is released and the arm 17 is once again rotated in the direction of the arrow 26. This rotation causes the dummy bar 6 to be fed into the inlet end of the mold 1 as is also illustrated in FIG. 2. The dummy bar 6 passes through the mold 1 into the guide 2 and is positioned in readiness for the start of another cast.

The dummy bar 6 shown is a so-called short dummy bar. It is however, possible to use a long dummy bar instead, e.g. a dummy bar which extends from the mold 1 to the withdrawal and straightening unit 3.

The arrangement according to the invention is not limited to the casting of particular cross-sectional configurations. For example, the arrangement of the invention may be used for the casting of billets, blooms and slabs.

It will be understood that various modifications may be made without departing from the scope of the invention.

I claim:

1. A continuous casting installation comprising:

(a) a casting platform;

(b) an open-ended mold supported by said casting platform;

(c) a flexible dummy bar for sealing the outlet end of said mold prior to the start of a cast and for initiating withdrawal of a continuously cast strand from said mold;

(d) a guide below said casting platform for guiding the strand along a predetermined path; and (e) transporting means for lifting said dummy bar from said guide to a predetermined location of said casting platform spaced from said mold, transferring said dummy bar from said predetermined location to said mold and inserting said dummy bar into said guide via the inlet end of said mold, said transporting means including a carriage on said casting platform movable between said predetermined location and another location adjacent to said mold, and said carriage being provided with a part-circular, downwardly concave support for said dummy bar and an arm for engaging said dummy bar, said arm being telescopic and being pivotally mounted on the axis of said support such that rotation of said arm in a predetermined sense when said arm engages said dummy bar causes said dummy bar to be drawn onto said support, and said transporting means further including actuating means for telescoping, retracting and pivoting said arm so as to telescope said arm into engagement with the leading end of said dummy bar when said leading end is adjacent to said support, pivot said arm while in engagement with said leading end to draw said dummy bar onto said support, retract said arm from said leading end when said dummy bar is on said support, pivot said arm towards the trailing end of said dummy bar and telescope said arm into engagement with said trailing end to thereby effect controlled insertion of said dummy bar into said guide, said transporting means also including holding means for holding said dummy bar on said support while said arm pivots from said leading end towards said trailing end.

2. An installation as defined in claim 1, wherein said support is substantially semi-circular and has a length at least equal to the length of said dummy bar.

3. An installation as defined in claim 1, wherein said support comprises rollers and said holding means comprises a device on said carriage for arresting said dummy bar on said support.

4. An installation as defined in claim 3, wherein said device comprises a piston-and-cylinder unit having a fork-shaped portion for engaging said dummy bar.

5. An installation as defined in claim 1, said support having an exit end via which said dummy bar is guided into said inlet end of said mold; and wherein said support is provided with a centering device in the region of said exit end for centering said dummy bar relative to said mold.

6. An installation as defined in claim 1, wherein said arm comprises an axially movable portion of fork-like configuration for engaging said dummy bar.

7. An installation as defined in claim 1, wherein said actuating means comprises a drive chain for pivoting said arm, and said drive chain is arranged such that at least a portion thereof is concentric with said support.

8. A continuous casting method comprising the steps of:

(a) sealing the outlet end of an open-ended mold with the trailing end of a flexible dummy bar, said mold being supported on a casting platform;

(b) admitting molten material into the inlet end of said mold to begin formation of a continuously cast strand;

(c) moving said dummy bar downwardly from said mold along a predetermined path to initiate withdrawal of said strand from said mold;

(d) removing said dummy bar from said path subsequent to initiating withdrawal of said strand from said mold, the removing step being performed by lifting said dummy bar so that the leading end thereof is raised to the region of a predetermined location of said casting platform spaced from said mold;

(e) drawing said dummy bar onto a part-circular, downwardly concave support mounted on a carriage which is adjacent to said predetermined location and is movable between the latter and another location adjacent to said mold, said carriage having an arm which is pivotally mounted on the axis of said support, and the drawing step being performed by engaging said leading end of said dummy bar with said arm when the latter is in a first position thereof and rotating said arm to a second position thereof such that said dummy bar rests on said support;

(f) disengaging said arm from said leading end of said dummy bar;

(g) rotating said arm towards said first position;

(h) engaging the trailing end of said dummy bar with said arm;

(i) moving said carriage to said other location; and (j) rotating said arm towards said second position to thereby lower said dummy bar through said inlet end of said mold to a position in which said trailing end of said dummy bar seals said outlet end of said mold preparatory to the start of another cast.

9. A method as defined in claim 8, wherein said dummy bar is arrested prior to the disengaging step and released subsequent to the step of engaging said trailing end of said dummy bar with said arm.

* * * * *